US010550339B2

(12) United States Patent
Roney

(10) Patent No.: US 10,550,339 B2
(45) Date of Patent: Feb. 4, 2020

(54) DIESEL AND CYCLE OIL UPGRADING PROCESS

(71) Applicant: UOP LLC, Des Plaines, IL (US)

(72) Inventor: Scott M. Roney, Wheaton, IL (US)

(73) Assignee: UOP LLC, Des Plaines, IL (US)

( * ) Notice: Subject to any disclaimer, the term of this patent is extended or adjusted under 35 U.S.C. 154(b) by 19 days.

(21) Appl. No.: 16/040,198

(22) Filed: Jul. 19, 2018

(65) Prior Publication Data

US 2019/0062653 A1 Feb. 28, 2019

Related U.S. Application Data

(60) Provisional application No. 62/549,643, filed on Aug. 24, 2017.

(51) Int. Cl.
*C10G 65/12* (2006.01)
*C10G 67/06* (2006.01)

(52) U.S. Cl.
CPC ..... *C10G 65/12* (2013.01); *C10G 67/06* (2013.01); *C10G 2300/1096* (2013.01); *C10G 2300/205* (2013.01); *C10G 2300/307* (2013.01); *C10G 2400/04* (2013.01)

(58) Field of Classification Search
CPC ..... C10G 65/12; C10G 67/06; C10G 2300/1096; C10G 2300/307; C10G 2300/205; C10G 2400/04
See application file for complete search history.

(56) References Cited

U.S. PATENT DOCUMENTS 5,401,389 A * 3/1995 Mazzone ..... C10G 69/08 208/212
8,066,867 B2 * 11/2011 Dziabala ..... C10G 65/12 208/57
2003/0221990 A1 * 12/2003 Yoon ..... C10G 65/10 208/59

* cited by examiner

*Primary Examiner* — Brian A McCaig
(74) *Attorney, Agent, or Firm* — Paschall & Maas Law Office, LLC; James C. Paschall

(57) ABSTRACT

A process is for hydrocracking a dealkylated aromatic stream in the presence of a hydrogen stream and a hydrocracking catalyst to provide a hydrocracked stream and hydrotreating a diesel stream and the hydrocracked stream together over a hydrotreating catalyst to provide a hydrotreated diesel stream. The two streams are processed together without cracking the valuable diesel boiling hydrocarbons to below the diesel range and also upgrading the cetane value of the dealkylated aromatic stream.

20 Claims, 1 Drawing Sheet

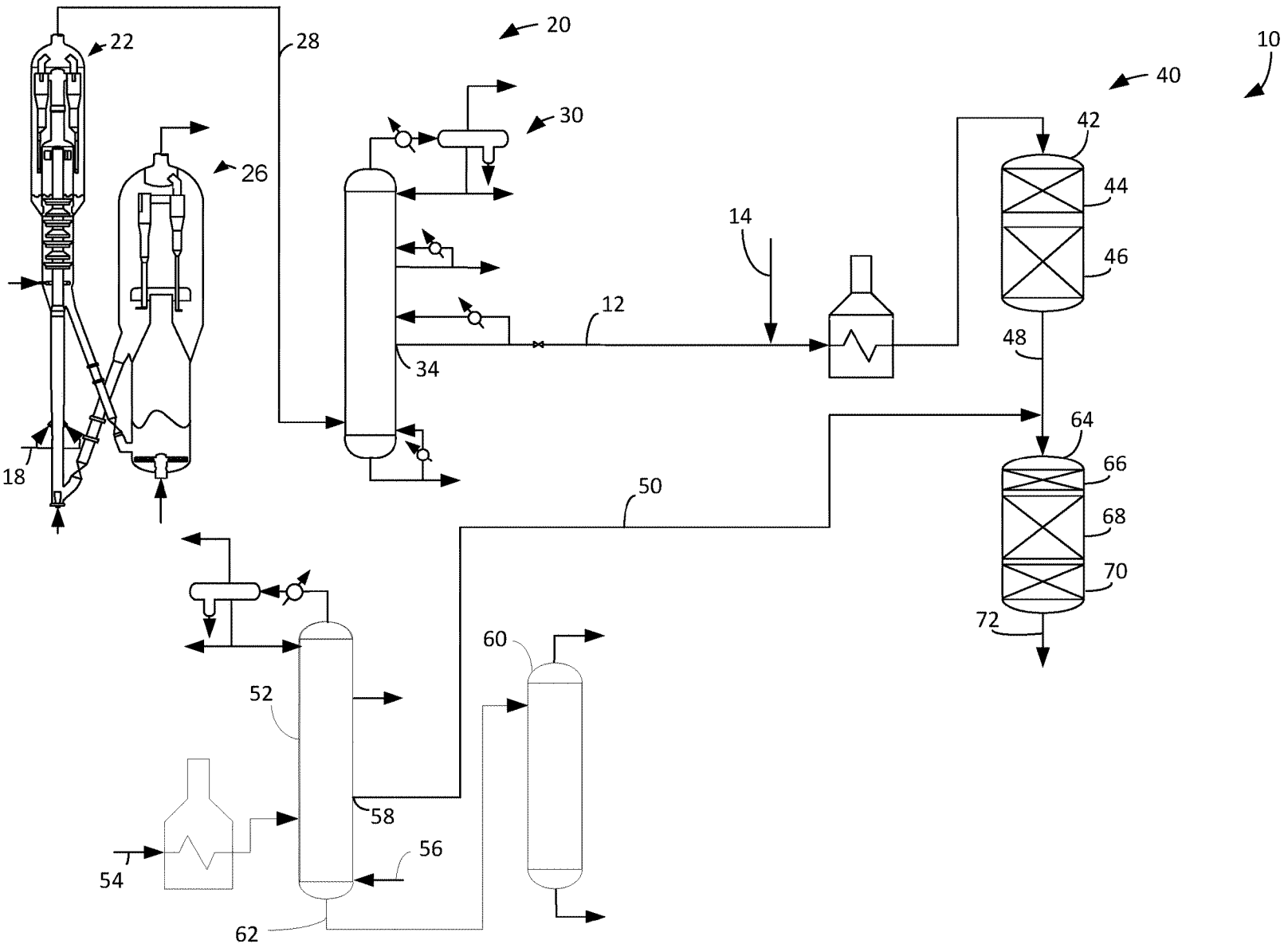
10
40
42
44
46
48
64
66
68
70
72
14
12
50
20
30
34
60
56
58
28
26
52
62
22
54
18

DIESEL AND CYCLE OIL UPGRADING PROCESS

CROSS-REFERENCE TO RELATED APPLICATION

This application claims priority from U.S. Provisional Application No. 62/549,643 filed Aug. 24, 2017, the contents of which cited application are hereby incorporated by reference in its entirety.

FIELD

The field of the subject matter is hydroprocessing.

BACKGROUND

Hydroprocessing can include processes which convert hydrocarbons in the presence of hydroprocessing catalyst and hydrogen to more valuable products.

Hydrotreating is a hydroprocessing process used to remove heteroatoms such as sulfur and nitrogen from hydrocarbon streams to meet fuel specifications and to saturate olefinic or aromatic compounds. Hydrotreating can be performed at high or low pressures, but is typically operated at lower pressure than hydrocracking.

Hydrocracking is a hydrocracking process in which hydrocarbons crack in the presence of hydrogen and hydrocracking catalyst to lower molecular weight hydrocarbons. Depending on the desired output, the hydrocracking reactor may contain one or more beds of the same or different catalyst. Hydrocracking is a process used to crack hydrocarbon feeds such as vacuum gas oil (VGO) to diesel including kerosene and gasoline motor fuels.

Fluid catalytic cracking (FCC) is the predominant source of gasoline production in many refineries as the result of cracking heavier, less valuable hydrocarbon feed stocks such as VGO. The FCC unit comprises a reactor that is closely coupled with a regenerator, followed by downstream hydrocarbon product separation. Hydrocarbon feed contacts catalyst in the reactor to crack the hydrocarbons down to smaller molecular weight products. During this process, coke tends to accumulate on the catalyst which is burned off in the regenerator.

Light cycle oil (LCO) is produced in an FCC unit and can be withdrawn as a side stream from the FCC main fractionation column. LCO is a dealkylated aromatic typically comprising two aromatic rings. LCO can be directed to the diesel pool but it may degrade the quality of the diesel pool due to its high aromaticity and low cetane value. Heavy cycle oil (HCO) is an FCC liquid stream pumped around to cool the main fractionation column but is not often recovered from the main fractionation column.

Straight run diesel (SRD) is a hydrocarbon stream boiling in the diesel boiling range that is provided by distilling crude oil in a crude fractionation column and taken as a side stream from the crude column.

There is a need, therefore, for improved processes and apparatuses for processing diesel and LCO together but that preserve or boost cetane of the blended diesel stream.

BRIEF SUMMARY

A process hydrocracks a dealkylated aromatic stream in the presence of a hydrogen stream and a hydrocracking catalyst to provide a hydrocracked stream. A diesel stream and at least the liquid portion of the hydrocracked stream are then hydrotreated together over a hydrotreating catalyst to provide a hydrotreated diesel stream. The two streams are processed together without cracking the valuable diesel boiling hydrocarbons to below the diesel range and also upgrading the cetane value of the dealkylated aromatic stream.

BRIEF DESCRIPTION OF THE DRAWING

The FIGURE is a schematic drawing of the process and apparatus.

DEFINITIONS

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "bypass" means that the object is out of downstream communication with a bypassing subject at least to the extent of bypassing.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Feeds to the columns may be preheated. The top pressure is the pressure of the overhead vapor at the vapor outlet of the column. The bottom temperature is the liquid bottom outlet temperature. Overhead lines and bottoms lines refer to the net lines from the column downstream of the reflux or reboil to the column.

As used herein, the term "True Boiling Point" (TBP) means a test method for determining the boiling point of a material which corresponds to ASTM D2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

As used herein, the term "T5" or "T95" means the temperature at which 5 volume percent or 95 volume percent, as the case may be, respectively, of the sample boils using TBP or ASTM D-86.

As used herein, the term "initial boiling point" (IBP) means the temperature at which the sample begins to boil using ASTM D-86.

As used herein, the term "end point" (EP) means the temperature at which the sample has all boiled off using ASTM D-86.

As used herein, the term "diesel boiling range" means hydrocarbons boiling in the range of an IBP between about 125° C. (257° F.) and about 175° C. (347° F.) or a T5 between about 150° C. (302° F.) and about 200° C. (392° F.) and the "diesel cut point" comprising a T95 between about 343° C. (650° F.) and about 399° C. (750° F.) using TBP.

As used herein, the term "diesel conversion" means conversion of feed that boils above the diesel cut point to material that boils at or below the diesel cut point in the diesel boiling range.

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator that may be operated at higher pressure.

DETAILED DESCRIPTION

An economic incentive exists to upgrade LCO into diesel by co-processing LCO in a diesel hydrotreater with SRD. However, due to the highly aromatic character of LCO, even fully saturating LCO results in a largely naphthenic material with a cetane number (CN) rarely exceeding 35; whereas, most markets require at least 49 if not 51 CN. To increase CN further, the rings in the LCO must be opened, but this is a difficult reaction that is only achievable with highly-active and perhaps poorly-selective catalysts that crack most of the SRD into lighter, less valuable products. In some cases, the diesel also needs to be upgraded by reducing its end point and/or improving its cold flow properties such as via hydroisomerization but this requires low-activity distillate-selective catalysts to preserve diesel yield. The mismatch between the needs of these two feeds makes co-processing SRD and LCO challenging and often unfeasible.

It is proposed to optionally, partially hydrotreat a dealkylated aromatic stream such as LCO across a relatively small bed of pretreat hydrotreating catalyst and then hydrocrack the hydrotreated dealkylated aromatic stream cracked across a larger bed of high-activity hydrocracking catalyst at a perhaps several times lower LHSV. The hydrocracked, partially desulfurized, denitrogenated and saturated stream is then combined with diesel, such as SRD, and passed over an optional small guard bed to remove metals in the SRD and a large bed of hydrotreating catalyst for saturation and desulfurization. If necessary, a small bed of low-activity post-cracking hydrocracking catalyst hydrocracks the hydrotreated stream below the large bed of hydrotreating catalyst.

The proposed process prevents the diesel stream from being cracked into materials boiling below the diesel boiling range. It maximizes hydrotreating catalyst utilization by only denitrogenating the dealkylated aromatic stream sufficiently to preserve the acid sites of the hydrocracking catalyst to enable ring-opening and desulfurization across the high-activity hydrocracking catalyst. The hydrocracked LCO and SRD are hydrotreated together to saturate aromatic rings and olefins. The addition of the diesel stream also provides a further means of temperature control by quench.

The end result is the hydroprocessing of two qualitatively different streams in a single hydroprocessing unit, simultaneously upgrading the value of both. It may be possible to revamp an existing unit, by modifying the internals to inject the diesel stream in between catalyst beds or reactors.

The process 10 for upgrading diesel streams comprises a first feed stream comprising a dealkylated aromatic stream in a first feed line 12. The dealkylated aromatic stream may be a cycle oil stream, particularly a LCO stream that may be taken from a main fractionation column 30 for an FCC unit 20. In the FCC unit 20 a hydrocarbon stream in a FCC feed line 18 such as VGO is contacted with a cracking catalyst which may comprise a Y zeolite in a reactor vessel 22 to crack the VGO to lighter fuel range hydrocarbons such as naphtha, primarily. Conditions in the reactor vessel 22 are atmospheric and between about 550 and about 650° C. Spent catalyst is separated from cracked products and transferred to a regenerator 26 in which coke on spent catalyst is combusted at about 700 to about 800° C. to regenerate the catalyst which is returned to the reactor vessel 22. Cracked product vapors are transferred to a main fractionation column 30 to separate cracked products into product streams including LPG, naphtha, diesel, LCO and slurry oil. The LCO stream in first feed line 12 is taken from a side outlet 34 from the main fractionation column 30 to provide the dealkylated aromatic stream. Pump-around circuits may be used on streams taken from the main fractionation column 30 to cool the main fractionation column.

The first feed line 12 delivers the dealkylated aromatic stream to a hydroprocessing unit 40. A hydrogen stream in hydrogen line 14 may be added to the dealkylated aromatic stream in the first feed line 12. The dealkylated aromatic stream may be heated in a charge heater and fed to a first hydroprocessing reactor 42. The first hydroprocessing reactor may comprise a pretreat hydrotreating catalyst bed 44 and a hydrocracking catalyst bed 46. The hydrocracking catalyst bed 46 should be downstream of the pretreat hydrotreating catalyst bed 44. In the first hydroprocessing reactor 42, the dealkylated aromatic stream is hydrocracked in the presence of the hydrogen stream and a hydrocracking catalyst to provide a hydrocracked stream.

The dealkylated aromatic stream is preferably hydrotreated in the presence of the hydrogen stream and a pretreating catalyst before it is hydrocracked. Hydrotreating is a process wherein hydrogen is contacted with hydrocarbon in the presence of hydrotreating catalyst which is primarily active for the removal of heteroatoms, such as sulfur, nitrogen and metals from the hydrocarbon feedstock. In hydrotreating, hydrocarbons with double and triple bonds and aromatics may be partially or completely saturated.

Suitable pretreat hydrotreating catalyst for use in the first hydroprocessing reactor 40 is any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Phosphorous may also be incorporated into the catalyst. Other suitable hydrotreating catalysts include zeolitic catalysts. More than one type of first hydrotreating catalyst may be used in the hydrotreating reactor 12. The Group VIII metal is typically present in an amount ranging from about 2 to about 20 wt %, preferably from about 4 to about 12 wt %. The Group VI metal will typically be present in an amount ranging from about 1 to about 25 wt %, preferably from about 2 to about 25 wt %.

The pretreat hydrotreating catalyst bed 44 may comprise about 10 to about 20% of the total catalyst volume in the hydroprocessing unit 40. Typically, no guard bed is needed since a dealkylate aromatic stream such as LCO typically has no metals, silicon, arsenic, or other such contaminants, but some particulate trap material may be helpful for reducing fouling. The pretreat hydrotreating catalyst bed 44 should be operated and sized to convert about 80 to about 95 wt %, preferably about 85 to about 90 wt % of the organic nitrogen in the feed in the dealkylated aromatic stream to ammonia and hydrocarbons.

A hydrotreated dealkylated aromatic stream exits the pretreat hydrotreating catalyst bed 44 and preferably the entire hydrotreated dealkylated aromatic stream enters a hydrocracking catalyst bed 46 in total. In an aspect, the pretreat hydrotreating catalyst bed 44 and the hydrocracking catalyst bed may be in the same reactor vessel as different beds. They may, however, be located in different reactor vessels. Hydrogen may be added to the hydrotreated dealkylated aromatic stream between the pretreat hydrotreating catalyst bed 44 and the hydrocracking catalyst bed for quench and to supplement hydrogen requirements. The hydrotreated dealkylated aromatic stream is hydrocracked in the presence of the hydrogen stream and a hydrocracking catalyst to provide a hydrocracked stream.

The hydrocracking catalysts that utilize amorphous silica-alumina bases or low-level zeolite bases combined with one or more Group VIII or Group VIB metal hydrogenating components. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and about 14 Angstroms ($10^{-10}$ meters). It is preferred to employ zeolites having a relatively high silica/alumina mole ratio between about 3 and about 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8-12 Angstroms, wherein the silica/alumina mole ratio is about 4 to 6. One example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Zeolites, such as Y zeolites may be steamed and acid washed to dealuminate the zeolite structure.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. In one aspect, the preferred cracking bases are those which are at least about 10 percent, and preferably at least about 20 percent, metal-cation-deficient, based on the initial ion-exchange capacity. In another aspect, a desirable and stable class of zeolites is one wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and about 30 percent by weight may be used. In the case of the noble metals, it is normally preferred to use about 0.05 to about 2 wt-%.

The method for incorporating the hydrogenating metal is to contact the base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., about 371° (700° F.) to about 648° C. (1200° F.) in order to activate the catalyst and decompose ammonium ions. Alternatively, the base component may first be pelleted, followed by the addition of the hydrogenating component and activation by calcining.

The foregoing catalysts may be employed in undiluted form, or the powdered catalyst may be mixed and copelleted with other relatively less active catalysts, diluents or binders such as alumina, silica gel, silica-alumina cogels, activated clays and the like in proportions ranging between about 5 and about 90 wt-%. These diluents may be employed as such or they may contain a minor proportion of an added hydrogenating metal such as a Group VIB and/or Group VIII metal. Additional metal promoted hydrocracking catalysts may also be utilized in the process of the present invention which comprises, for example, aluminophosphate molecular sieves, crystalline chromosilicates and other crystalline silicates.

The hydrocracking catalyst preferably has high activity such as comprising at least about 40 to about 60 wt % dealuminated Y zeolite or at least about 15 to about 35 wt % non-dealuminated Y zeolite or at least about 3 to about 10 wt % beta zeolite, or some combination thereof yielding similar activity. In each case, mass-transfer limitations are expected to be significant and thus smaller-diameter extrudates such as 1/16 inch cylinders or 1/16 inch trilobes may give the best performance. The hydrocracking catalyst bed 46 may comprise about 30 to about 60% of the total catalyst volume in the hydroprocessing unit 40.

The hydrocracking catalyst bed 46 has a larger volume than the pretreat hydrotreating catalyst bed 44, and so hydrocracking the dealkylated aromatic stream operates at a lower space velocity than hydrotreating the dealkylated aromatic stream. The denitrogenated dealkylated aromatic stream enables the acid sites of the hydrocracking catalyst to open rings and desulfurize the dealkylated aromatic stream. The hydrocracked stream comprising hydrocracked dealkylated aromatics may exit the hydrocracking catalyst bed 46 in hydrocracking effluent line 48.

A diesel feed stream in a second feed line 50 may mix with the hydrocracked stream in the hydrocracking effluent line 48. In an aspect, at least all of the liquid of said hydrocracked stream and preferably all of the hydrocracked stream exiting hydrocracking bed mix with the diesel feed stream.

The diesel stream boils in the diesel boiling range. Preferably, the diesel stream is a SRD taken from a crude fractionation column 52 operating above atmospheric pressure. A crude oil stream 54 is heated in a furnace perhaps after dewatering the crude oil stream. The crude oil stream may be characterized as a heavy hydrocarbon stream having properties in at least one of the following ranges: pour point of greater than about 20° C., viscosity greater than about 10,000 cSt at about 38° C. (100° F.) and an API gravity typically greater than 18 API. The heated crude oil stream 54 is fractionated in the crude fractionation column 52 which may be stripped with steam from line 56. The crude fractionation column 52 may produce light gases, naphtha, diesel and atmospheric gas oil. SRD is produce from a side outlet 58 of the crude fractionation column 52 in diesel line 50. An atmospheric gas oil stream in bottoms line 62 from the crude fractionation column 52 may be fed to a vacuum fractionation column 60 to separate a VGO stream in the overhead from a vacuum resid stream in the bottoms. Streams produced from side outlets of the crude fractionation column 52 may be stripped of volatiles in a dedicated stripping column with volatiles being returned to the crude fractionation column. Pump-around circuits may also be used on streams taken from the crude column 52 to cool the crude column.

The SRD stream in a second feed line 50 may be the diesel stream that mixes with the hydrocracked stream in the hydrocracking effluent line 48. In an aspect, at least all of the liquid of the hydrocracked stream and preferably all of the hydrocracked stream exiting hydrocracking bed in the hydrocracking feed line mix with the SRD stream in diesel line 50 and may be fed together to the second hydroprocessing reactor 64. The addition of the diesel stream from line 50 may serve to quench the hydrocracked effluent in hydrocracking effluent line 48 to control its temperature.

In an aspect, the diesel stream from diesel line 50 and all of the liquid of the hydrocracked stream are hydrotreated together over a hydrotreating catalyst in a hydrotreating catalyst bed 68 to provide a hydrotreated diesel stream. At least all of the liquid of the hydrocracked stream from the hydrocracking catalyst bed 46 is hydrotreated with the diesel stream. In an aspect, the diesel stream from diesel line 50 and all of the hydrocracked stream are hydrotreated together over the hydrotreating catalyst to provide the hydrotreated diesel stream.

In an aspect, the diesel stream mixed with the hydrocracked stream may be passed over a small guard bed 66 of hydrotreating catalyst to adsorb metals from the diesel stream before hydrotreating the diesel stream. Metals may be present in SRD that can impair the hydrotreating catalyst. The guard bed catalyst should be a standard large pore nickel-molybdenum hydrotreating catalyst designed to remove metals with hydrodesulfurization and more importantly hydrodenitrogenation activity. The guard bed catalyst should comprise no more than 5% of the total volume of catalyst in the hydroprocessing unit 40. The guard bed 66 may be the first bed in second hydroprocessing reactor 64. The metals depleted hydrocracked stream may pass from the guard bed 66 into the hydrotreating bed 68.

In the hydrotreating catalyst bed 68, the hydrocracked dealkylated aromatic stream and the diesel stream together have olefins converted to paraffins and aromatics converted to naphthenes. The hydrotreating catalyst in the hydrotreating catalyst bed 68 should be high-activity high activity nickel molybdenum phosphorous catalyst or a precipitated trimetallic catalyst. The hydrotreating catalyst in the hydrotreating catalyst bed 68 should comprise about 20 to about 30% of the total catalyst volume. A hydrotreated diesel stream may exit the hydrotreating catalyst bed 68.

In an aspect, if the end point of the hydrotreated diesel stream is higher than specification, a postcracking catalyst bed 70 of lower activity hydrocracking catalyst may be installed downstream of the hydrotreating catalyst bed 68 in the second hydroprocessing reactor 64. The postcracking catalyst bed 70 may be smaller than the hydrotreating catalyst bed 68. The hydrotreated diesel stream may be hydrocracked over the postcracking catalyst in the presence of hydrogen to reduce its end point. The postcracking catalyst may have predominantly more hydroisomerization activity than hydrocracking activity in an aspect. The postcracking catalyst may have no more than about 10 to about 20 wt % dealuminated Y zeolite. The postcracking catalyst bed may comprise about 5 to about 15% of the total catalyst volume in the hydroprocessing unit 40.

Because the hydrotreating catalyst bed 68 is larger than the postcracking catalyst bed 70, the diesel stream and the hydrocracked stream are hydrotreated at a lower space velocity than the space velocity at which the hydrotreated diesel stream is hydrocracked.

In the FIGURE, the hydroprocessing unit 40 comprises two hydroprocessing reactors 42 and 64, with beds 44 and 46 in the first hydroprocessing reactor 42 and beds 66, 68 and 70 in the second hydroprocessing reactor 64. However, it is contemplated that all of the beds could be in a single hydroprocessing reactor or in more than two hydroprocessing reactors, such as one reactor for each bed. It is contemplated that all of the effluent from one catalyst bed will cascade into the downstream catalyst bed. However, separations to remove volatile portions of a respective effluent from an upstream catalyst before entry into the downstream catalyst bed is contemplated.

The hydroprocessing conditions in all of the beds of the hydroprocessing unit 40 may include a temperature from about 290° C. (550° F.) to about 468° C. (875° F.), preferably 343° C. (650° F.) to about 435° C. (815° F.), a pressure from about 6.9 MPa (1000 psig) to about 11 MPa (1600 psig), an overall liquid hourly space velocity (LHSV) from about 0.6 to about 1.8 $hr^{-1}$ and a hydrogen rate of about 590 (3,500 scf/bbl) to about 1180 $Nm^3/m^3$ oil (7,000 scf/bbl). Supplemental hydrogen may be added at an interstage location between catalyst beds in the hydroprocessing reactors 42 and 64. In an aspect, the hydrogen stream in hydrogen line 14 added to the dealkylated aromatic stream in the first feed line 12 provides all of the hydrogen requirements for the hydrocracking step and the hydrotreating steps in the hydroprocessing unit 40. In a further aspect, the hydrogen stream in hydrogen line 14 added to the dealkylated aromatic stream in the first feed line 12 provides all of the hydrogen requirements for some or all of the pretreating step, the hydrocracking step, the adsorption step, the hydrotreating step and the postcracking step in the hydroprocessing unit 40.

An upgraded dealkylated aromatic and diesel stream exits the second hydroprocessing reactor 64 and the hydroprocessing unit 40 in a product line 72. Two qualitatively different stream are thus processed in a single hydroprocessing unit, simultaneously upgrading the value of both streams. It is contemplated that an existing hydroprocessing reactor can be modified to practice this process by injecting diesel between catalyst beds in a single reactor. The upgraded dealkylated aromatic and diesel stream in product line 72 may be forward to product separation and fractionation.

SPECIFIC EMBODIMENTS

While the following is described in conjunction with specific embodiments, it will be understood that this description is intended to illustrate and not limit the scope of the preceding description and the appended claims.

A first embodiment of the invention is a process comprising adding a hydrogen stream to a dealkylated aromatic stream; hydrocracking the dealkylated aromatic stream in the presence of the hydrogen stream and a hydrocracking catalyst to provide a hydrocracked stream; hydrotreating a diesel stream and all liquid of the hydrocracked stream together over a hydrotreating catalyst to provide a hydrotreated diesel stream. An embodiment of the invention is one, any or all of prior embodiments in this paragraph up through the first embodiment in this paragraph further comprising hydrotreating the diesel stream and all of the hydrocracked stream together. An embodiment of the invention is one, any or all of prior embodiments in this paragraph up through the first embodiment in this paragraph further comprising hydrotreating the dealkylated aromatic stream in the presence of the hydrogen stream and a pretreating catalyst before hydrocracking the dealkylated aromatic stream. An embodiment of the invention is one, any or all of prior embodiments in this paragraph up through the first embodiment in this paragraph further comprising hydrocracking the dealkylated aromatic stream at a lower space velocity than hydrotreating the dealkylated aromatic stream. An embodiment of the invention is one, any or all of prior embodiments in this paragraph up through the first embodiment in this paragraph wherein the dealkylated aromatic stream is taken from a main fractionation column for an FCC unit. An embodiment of the invention is one, any or all of prior embodiments in this paragraph up through the first embodiment in this paragraph further comprising hydrocracking the hydrotreated diesel stream over a postcracking catalyst in the presence of hydrogen. An embodiment of the invention is one, any or all of prior embodiments in this paragraph up through the first embodiment in this paragraph further comprising hydrotreating the diesel stream and all liquid of the hydrocracked stream at a lower space velocity than hydrocracking the hydrotreated diesel stream. An embodiment of the invention is one, any or all of prior embodiments in this paragraph up through the first embodiment in this paragraph wherein the diesel stream is taken from a crude fractionation column. An embodiment of the invention is one, any or all of prior embodiments in this paragraph up through the first embodiment in this paragraph further comprising adsorbing metals from the diesel stream before hydrotreating the diesel stream. An embodiment of the invention is one, any or all of prior embodiments in this paragraph up through the first embodiment in this paragraph wherein the hydrogen stream provides all of the hydrogen requirements for the hydrocracking step and the hydrotreating step.

A second embodiment of the invention is a process comprising adding a hydrogen stream to a dealkylated aromatic stream; hydrocracking the dealkylated aromatic stream in the presence of the hydrogen stream and a hydrocracking catalyst to provide a hydrocracked stream; hydrotreating a diesel stream and all of the hydrocracked stream together over a hydrotreating catalyst to provide a hydrotreated diesel stream. An embodiment of the invention is one, any or all of prior embodiments in this paragraph up through the second embodiment in this paragraph further comprising hydrotreating the dealkylated aromatic stream in the presence of the hydrogen stream and a pretreating catalyst before hydrocracking the dealkylated aromatic stream. An embodiment of the invention is one, any or all of prior embodiments in this paragraph up through the second embodiment in this paragraph further comprising hydrocracking the dealkylated aromatic stream at a lower space velocity than hydrotreating the dealkylated aromatic stream. An embodiment of the invention is one, any or all of prior embodiments in this paragraph up through the second embodiment in this paragraph further comprising hydrocracking the hydrotreated diesel stream over a postcracking catalyst in the presence of hydrogen. An embodiment of the invention is one, any or all of prior embodiments in this paragraph up through the second embodiment in this paragraph further comprising hydrotreating the diesel stream and all liquid of the hydrocracked stream at a lower space velocity than hydrocracking the hydrotreated diesel stream. An embodiment of the invention is one, any or all of prior embodiments in this paragraph up through the second embodiment in this paragraph wherein the hydrogen stream provides all of the hydrogen requirements for the hydrocracking step and the hydrotreating step.

A third embodiment of the invention is a process comprising hydrotreating a dealkylated aromatic stream over a pretreat catalyst in the presence of a hydrogen stream to provide a pretreated dealkylated aromatic stream; hydrocracking the pretreated dealkylated aromatic stream in the presence of the hydrogen stream and a hydrocracking catalyst to provide a hydrocracked stream; hydrotreating a diesel stream and the hydrocracked stream together over a hydrotreating catalyst to provide a hydrotreated diesel stream; and hydrocracking the hydrotreated diesel stream over a postcracking catalyst in the presence of hydrogen. An embodiment of the invention is one, any or all of prior embodiments in this paragraph up through the third embodiment in this paragraph further comprising adsorbing metals from the diesel stream before hydrotreating the diesel stream. An embodiment of the invention is one, any or all of prior embodiments in this paragraph up through the third embodiment in this paragraph further comprising hydrocracking the dealkylated aromatic stream at a lower space velocity than hydrotreating the dealkylated aromatic stream. An embodiment of the invention is one, any or all of prior embodiments in this paragraph up through the third embodiment in this paragraph further comprising hydrotreating the diesel stream and the hydrocracked stream at a lower space velocity than hydrocracking the hydrotreated diesel stream.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process comprising: adding a hydrogen stream to a cycle oil stream; hydrocracking said cycle oil stream in the presence of the hydrogen stream and a hydrocracking catalyst to provide a hydrocracked stream; and hydrotreating a diesel stream and all liquid of said hydrocracked stream together over a hydrotreating catalyst to provide a hydrotreated diesel stream.

2. The process of claim 1 further comprising hydrotreating said diesel stream and all of said hydrocracked stream together.

3. The process of claim 2 further comprising hydrotreating said cycle oil stream in the presence of the hydrogen stream and a pretreating catalyst before hydrocracking said cycle oil stream.

4. The process of claim 3 further comprising hydrocracking said cycle oil stream at a lower space velocity than hydrotreating said cycle oil stream.

5. The process of claim 1 wherein said cycle oil stream is taken from a main fractionation column for an FCC unit.

6. The process of claim 1 further comprising hydrocracking said hydrotreated diesel stream over a postcracking catalyst in the presence of hydrogen.

7. The process of claim 6 further comprising hydrotreating said diesel stream and all liquid of said hydrocracked stream at a lower space velocity than hydrocracking said hydrotreated diesel stream.

8. The process of claim 1 wherein said diesel stream is taken from a crude fractionation column.

9. The process of claim 1 further comprising adsorbing metals from said diesel stream before hydrotreating said diesel stream and all liquid of the said hydrocracked stream.

10. The process of claim 1 wherein said hydrogen stream provides all of the hydrogen requirements for said hydrocracking step and said hydrotreating step.

11. A process comprising: adding a hydrogen stream to a cycle oil stream; hydrocracking said cycle oil stream in the presence of the hydrogen stream and a hydrocracking catalyst to provide a hydrocracked stream; and hydrotreating a diesel stream and all of said hydrocracked stream together over a hydrotreating catalyst to provide a hydrotreated diesel stream.

12. The process of claim 11 further comprising hydrotreating said cycle oil stream in the presence of the hydrogen stream and a pretreating catalyst before hydrocracking said cycle oil stream.

13. The process of claim 12 further comprising hydrocracking said cycle oil stream at a lower space velocity than hydrotreating said cycle oil stream.

14. The process of claim 11 further comprising hydrocracking said hydrotreated diesel stream over a postcracking catalyst in the presence of hydrogen.

15. The process of claim 14 further comprising hydrotreating said diesel stream and all liquid of said hydrocracked stream at a lower space velocity than hydrocracking said hydrotreated diesel stream.

16. The process of claim 11 wherein said hydrogen stream provides all of the hydrogen requirements for said hydrocracking step and said hydrotreating step.

17. A process comprising: hydrotreating a cycle oil stream over a pretreat catalyst in the presence of a hydrogen stream to provide a pretreated cycle oil stream; hydrocracking said pretreated cycle oil stream in the presence of the hydrogen stream and a hydrocracking catalyst to provide a hydrocracked stream; hydrotreating a diesel stream and said hydrocracked stream together over a hydrotreating catalyst to provide a hydrotreated diesel stream; and hydrocracking said hydrotreated diesel stream over a postcracking catalyst in the presence of hydrogen.

18. The process of claim 17 further comprising adsorbing metals from said diesel stream before hydrotreating said diesel stream and said hydrocracked stream.

19. The process of claim 17 further comprising hydrocracking said cycle oil stream at a lower space velocity than hydrotreating said cycle oil stream.

20. The process of claim 17 further comprising hydrotreating said diesel stream and said hydrocracked stream at a lower space velocity than hydrocracking said hydrotreated diesel stream.

* * * * *